US006536054B2

(12) United States Patent
Anderson et al.

(10) Patent No.: US 6,536,054 B2
(45) Date of Patent: Mar. 25, 2003

(54) VACUUM TOILET BOWL ASSEMBLY HAVING REMOVABLE BOWL

(75) Inventors: William Bruce Anderson, Rockford, IL (US); Mark A. Pondelick, Roscoe, IL (US); Jay D. Stradinger, Roscoe, IL (US); Douglas M. Wallace, Roscoe, IL (US); Arthur J. McGowan, Jr., Thornton, CO (US); Michael B. Hancock, Rockford, IL (US); Ian Tinkler, Rockford, IL (US)

(73) Assignee: Evac International Oy, Helsinki (FI)

( * ) Notice: Subject to any disclaimer, the term of this patent is extended or adjusted under 35 U.S.C. 154(b) by 0 days.

(21) Appl. No.: 10/054,061

(22) Filed: Jan. 22, 2002

(65) Prior Publication Data

US 2002/0062519 A1 May 30, 2002

Related U.S. Application Data

(63) Continuation of application No. 09/713,861, filed on Nov. 16, 2000, now Pat. No. 6,347,416.

(51) Int. Cl.[7] ..... E03D 11/00
(52) U.S. Cl. ..... 4/431; 4/434; 4/435
(58) Field of Search ..... 4/300, 316, 420, 4/429, 431–435, 479, 461, 474, DIG. 9, 458–460

(56) References Cited

U.S. PATENT DOCUMENTS

| | | | | |
|---|---|---|---|---|
| 3,239,849 A | | 3/1966 | Liljendahl | |
| 3,860,973 A | * | 1/1975 | Uyeda et al. | 4/332 |
| 3,922,730 A | | 12/1975 | Kemper | |
| 3,995,328 A | | 12/1976 | Carolan et al. | |
| 4,063,315 A | | 12/1977 | Carolan et al. | |
| 4,184,506 A | | 1/1980 | Varis etal. | |
| 4,246,925 A | | 1/1981 | Oldfelt | |
| 4,275,470 A | | 6/1981 | Badger et al. | |
| 4,357,719 A | | 11/1982 | Badger et al. | |
| 4,521,925 A | | 6/1985 | Chen et al. | |
| 4,713,847 A | | 12/1987 | Oldfelt et al. | |
| 5,007,117 A | | 4/1991 | Oldfelt et al. | |
| 5,133,583 A | | 7/1992 | Mattsson et al. | |
| 5,231,706 A | * | 8/1993 | Kendall | 4/420 |
| 5,271,105 A | * | 12/1993 | Tyler | 4/431 |
| 5,604,938 A | | 2/1997 | Tyler | |
| 5,732,417 A | | 3/1998 | Pondelick | |
| 5,909,968 A | * | 6/1999 | Olin et al. | 4/431 |
| 6,131,596 A | | 10/2000 | Monson | |
| 6,152,160 A | | 11/2000 | Bowder et al. | |
| 6,216,285 B1 | | 4/2001 | Olin | |

* cited by examiner

*Primary Examiner*—David J. Walczak
*Assistant Examiner*—Tuan Nguyen
(74) *Attorney, Agent, or Firm*—Marshall, Gerstein & Borun

(57) ABSTRACT

A vacuum bowl assembly for use in a vacuum toilet positioned on a support surface and having a discharge valve. The vacuum bowl assembly comprises a frame having a bottom member adapted to engage the support surface, and a top member defining a shoulder. A removable bowl is provided having a flange extending about an upper edge sized to engage the shoulder, and an outlet adapted for fluid communication with the discharge valve.

17 Claims, 4 Drawing Sheets

VACUUM TOILET BOWL ASSEMBLY HAVING REMOVABLE BOWL

This is a continuation of U.S. application Ser. No. 09/713,861, filed Nov. 16, 2000, now U.S. Pat. No. 6,347,416.

FIELD OF THE INVENTION

The present invention generally relates to toilets and, more particularly, to vacuum toilet systems.

BACKGROUND OF THE INVENTION

Vacuum toilet systems are generally known in the art for use in both vehicle and stationary applications. A vacuum toilet system typically comprises a bowl for receiving waste having an outlet connected to a vacuum sewer line. A discharge valve is disposed between the bowl outlet and vacuum sewer line to selectively establish fluid communication therebetween. The vacuum sewer line is connected to a collection tank that is placed under partial vacuum pressure by a vacuum source, such as a vacuum pump. When the discharge valve is opened, material in the bowl is transported to the sewer pipe as a result of the pressure difference between the interior of the bowl and the interior of the sewer line. Conventional vacuum toilet systems also include a source of rinse fluid and a rinse fluid valve for controlling introduction of rinse fluid into the bowl.

Repair and maintenance of vacuum toilet systems is often overly time consuming and labor intensive. Maintenance concerns are particularly significant in aircraft applications, in which a number of sub-systems are installed on board. According to general practice in the airline industry, each sub-system includes one or more components which must be replaced in the event of failure, such components being commonly referred to as line replaceable units (LRUs). Presently, the entire toilet assembly is defined as the LRU for the vacuum toilet system. As a result, an airline must stock one or more replacement toilets in case of a toilet failure, so that the replacement toilet may be swapped in for the faulty toilet. A "bench test" is then performed on the faulty toilet to determine which components have failed in the toilet. The faulty components are then repaired or replaced (which may include significant disassembly and reassembly of the toilet) so that the toilet may be reused on another aircraft.

Each of the steps performed during a toilet repair is overly difficult and time consuming. To remove an entire toilet assembly from an aircraft requires disassembly of at least four self-locking mounting fasteners, an electrical connection, a grounding strap, a potable water line connection, and a waste discharge pipe connection. Each connection may be difficult to access, and may require a particular tool in order to loosen and disconnect. The same connections must then be reconnected for the replacement toilet.

Even if it were possible to remove and replace a single toilet component, it would be overly difficult and time consuming to do so. Removal of a component would require disconnection of several wires and pipes, and the components are often located in areas which are difficult to access. Furthermore, it would be difficult to diagnose whether one component or several components had failed. There exists a multitude of combinations of simultaneous component failures, which may lead to trouble-shooting errors and the replacement or repair of non-faulty components.

Certain repairs, which may not require substantial amounts of trouble shooting to identify the failed components, still require significant amounts of disassembly and reassembly. The toilet bowl, for example, is typically formed of stainless steel covered with a non-stick coating that is subject to failure. In conventional toilets, the bowl is a structural, load bearing component that is attached to a base support. In some toilets, the base support is permanently attached to the bowl and therefore the entire toilet must be removed to replace the coating. In other toilets, the bowl is removable from the support base, and therefore fasteners must be removed and the bowl must be disconnected from the rinse fluid and discharge lines. In addition, the rinse ring or nozzle used to direct rinse fluid into the bowl must be removed. Furthermore, if the non-stick coating fails, the bowl must be removed from all of the other toilet components for a re-coating process, steps of which are performed at high temperatures to remove the old coating and apply a new coating to the toilet bowl surface. Accordingly, replacement of a conventional bowl is overly complicated and time consuming.

In addition, the use of the bowl as a structural, load-bearing member in conventional toilets overly limits the selection of bowl materials. Because the bowl must be capable of supporting the weight of a user and any components mounted thereto, it is typically made of a metal such as stainless steel. Because only rigid materials may be used, the selection of materials for use in conventional toilet bowls is overly limited.

SUMMARY OF THE INVENTION

In accordance with certain aspects of the present invention, a waste receptacle is provided for use in a vacuum toilet system having a discharge valve with an inlet. The waste receptacle comprises a support structure, and a bowl releasably attached to the support structure, the bowl defining an outlet adapted to engage and seal with the discharge valve outlet.

In accordance with additional aspects of the present invention, a vacuum bowl assembly is provided for use in a vacuum toilet positioned on a support surface and having a discharge valve with an inlet. The assembly comprises a frame having a bottom member adapted to engage the support surface, and a top member defining an opening, a pair of slots being formed in the top member. A removable bowl has a sidewall sized for insertion into the opening and a flange carrying a pair of tabs sized to lockingly engage the slots, the bowl defining an outlet adapted for fluid communication with the discharge valve inlet.

In accordance with further aspects of the present invention, a vacuum bowl assembly is provided for use in a vacuum toilet positioned on a support surface and having a discharge valve with an inlet. The assembly comprises a frame having a bottom member adapted to engage the support surface, and a top member defining an opening, a pair of slots being formed in the top member. A removable plastic bowl has a sidewall sized for insertion into the opening and a flange carrying a pair of tabs sized to lockingly engage the slots, the bowl defining an outlet adapted for fluid communication with the discharge valve inlet.

Other features and advantages are inherent in the apparatus claimed and disclosed or will become apparent to those skilled in the art from the following detailed description and its accompanying drawings.

DETAILED DESCRIPTION OF THE PREFERRED EMBODIMENTS

Figure 1A:
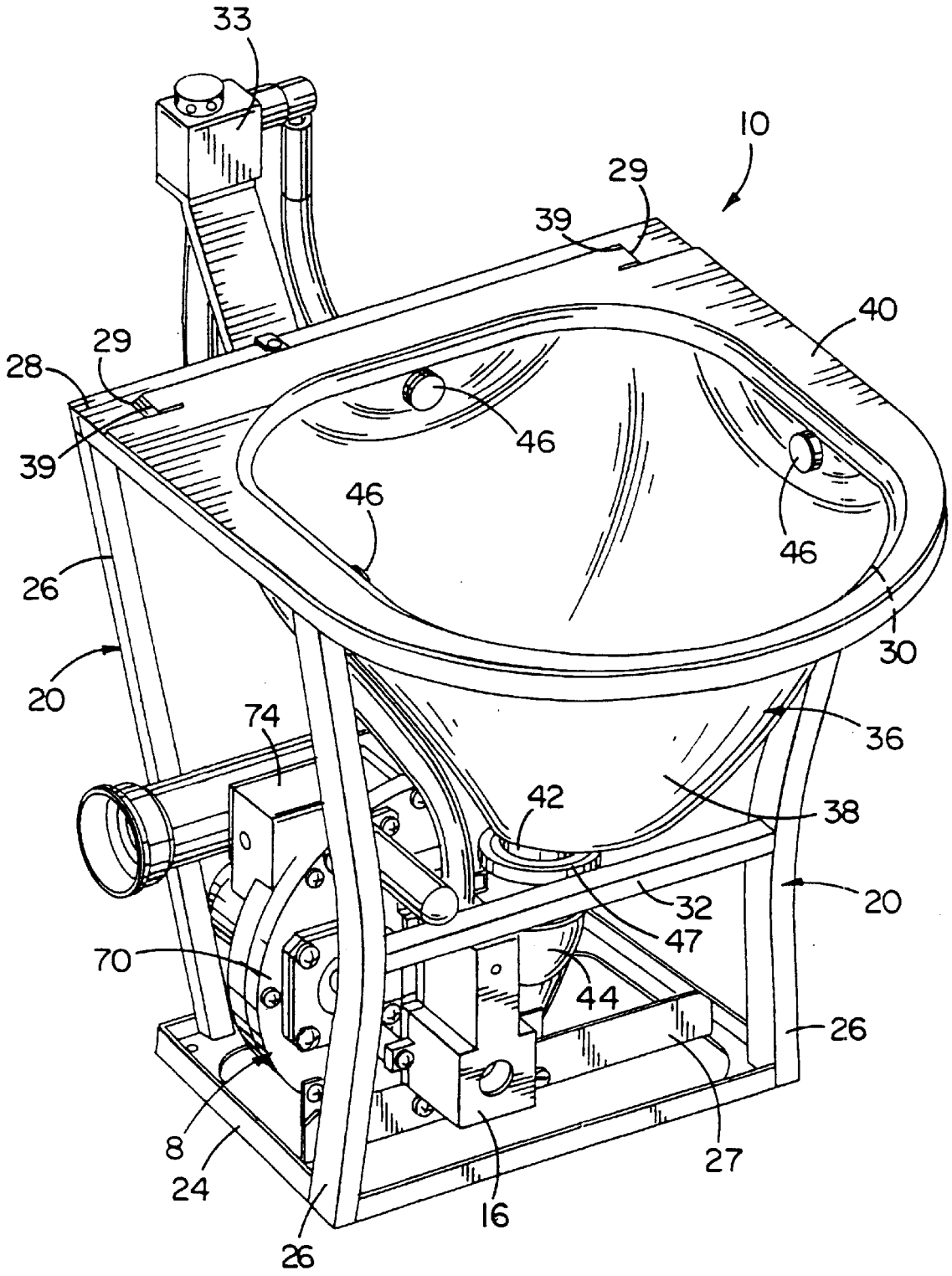
FIGS. 1A and 1B are front and rear perspective views, respectively, of a vacuum toilet frame and bowl in accordance with the present invention.
Figure 1B:
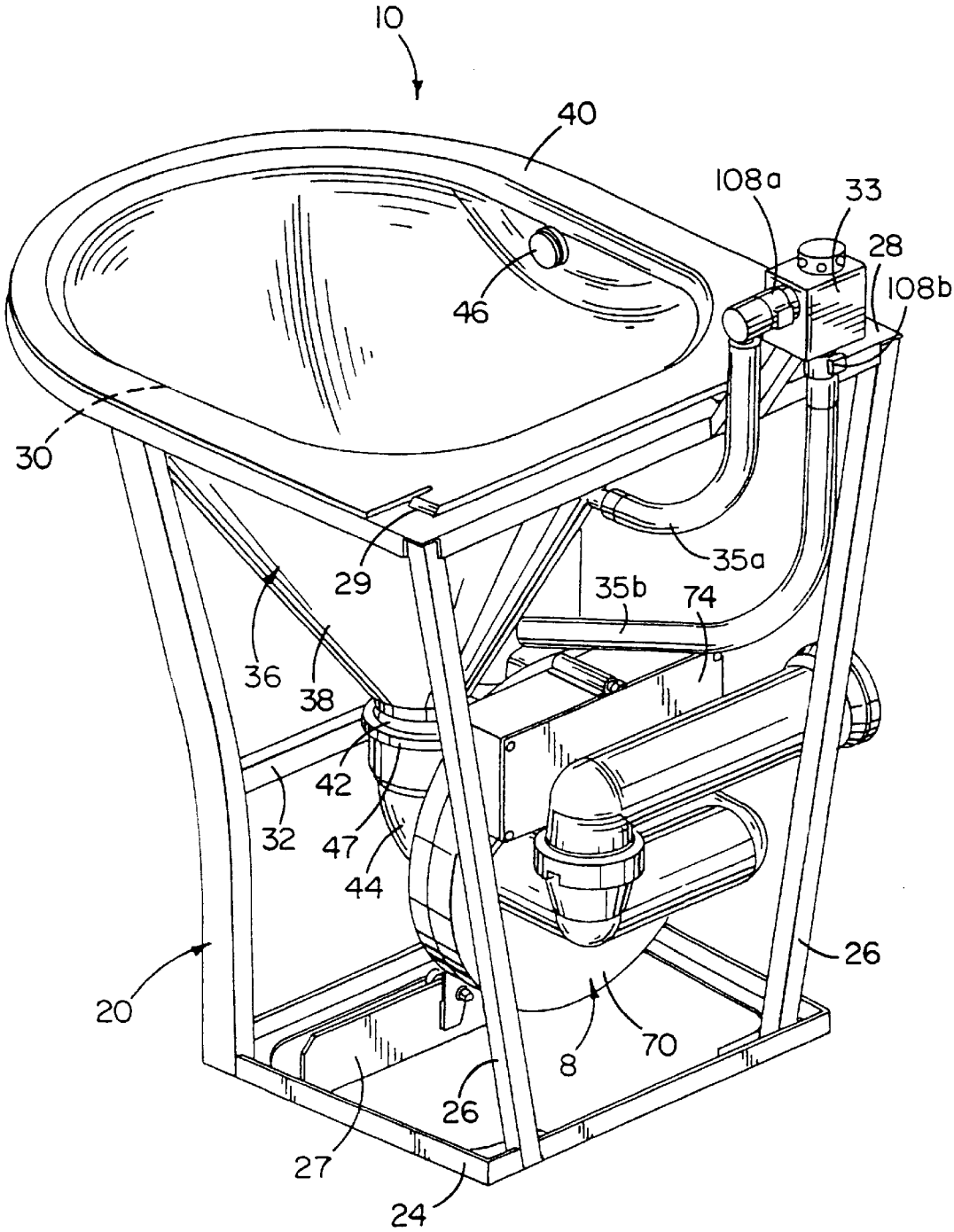
Figure 2:
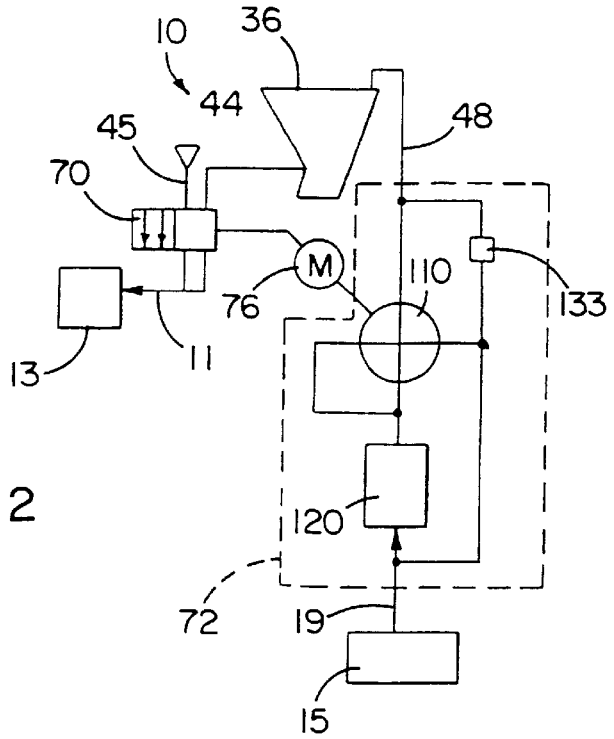
FIG. 2 is a schematic diagram of the vacuum toilet of FIG. 1.
Figure 3:
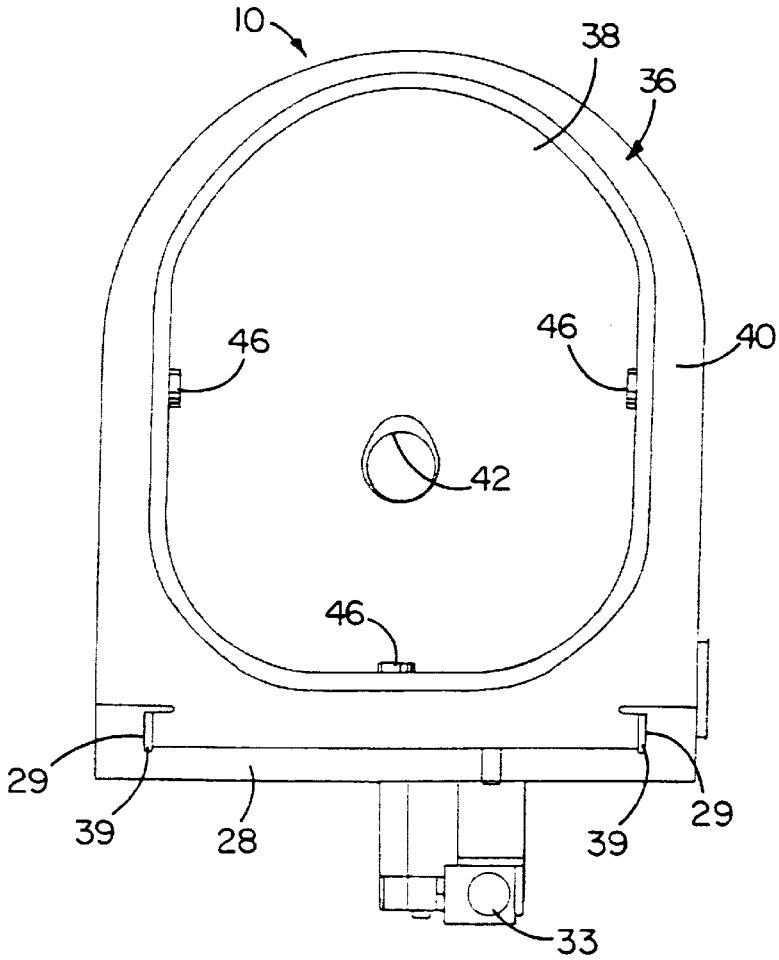
FIG. 3 is a top view of the bowl.

Referring initially to FIGS. 1A, 1B, and 2, a vacuum toilet 10 suitable for use in vehicle is shown including a frame 20 and bowl 36 in accordance with the present invention. The vehicle is provided with a sewer line 11, a vacuum tank 13 connected to the sewer line 11, and a vacuum source (not shown) for placing the vacuum tank 13 under partial vacuum pressure. The vehicle further includes a source of rinse fluid 15 connected to a rinse fluid supply line 19.

The toilet 10 preferably includes a discharge valve 70 adapted for connection to the vacuum tank, and a rinse valve 72 adapted for connection to the source of rinse fluid. A flush control unit (FCU) 74 is also provided for controlling operation of the discharge valve 70 and rinse valve 72. As shown in the illustrated embodiment, the discharge valve 70, rinse valve 72, and FCU 74 are preferably provided as an integral valve set 8, as described in greater detail in commonly owned and co-pending U.S. patent application Ser. No. 09/713,870, entitled "Integrated Valve Set For Vacuum Toilet" (Attorney Docket No. 05007/36582), incorporated herein by reference.

The frame 20 is provided for supporting the components of the vacuum toilet 10. As best shown with reference to FIGS. 1A and 1B, the frame 20 includes a bottom member 24 adapted for attachment to a support surface of the vehicle. Vertical supports 26 extend upwardly from the bottom member 24, and a top member 28 is attached to the vertical supports. The top member 28 is formed with an opening 30 near the front, and two slots 29 near the rear thereof. In the illustrated embodiment, an intermediate support 32 is attached between adjacent vertical supports 26, and a bracket 27 is attached to the bottom member 24. The bottom member 24, top member 28, and bracket 27 are preferably formed of sheet metal, while the vertical supports 26 and intermediate support 32 are preferably formed of tube steel, both of which are readily available and inexpensive. Other materials having sufficient rigidity, however, may also be used.

Figure 4:
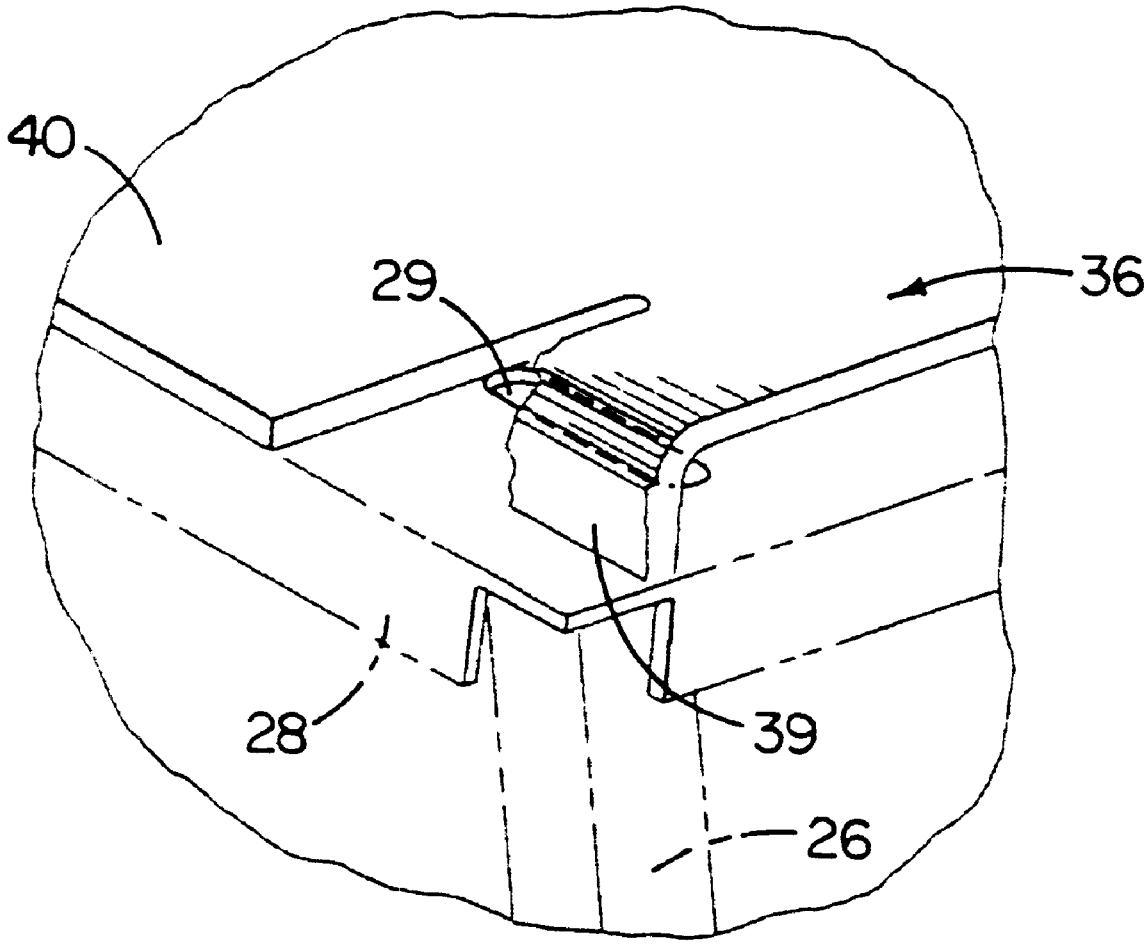
FIG. 4 is an enlarged view of a tab used to secure the bowl to the frame.

The bowl 36 is provided for receiving waste material. The bowl 36 has a curved sidewall 38 and an out-turned flange 40 extending about an upper edge of the sidewall (FIGS. 1A and 1B). The out-turned flange 40 further includes tabs 39 sized for insertion through the slots 29 formed in the frame top member 28, as best shown in FIG. 4. A bottom of the sidewall is formed in an outlet 42, and the sidewall 38 is sized for insertion into the opening 30 of the frame top member 28. The outlet 42 fluidly communicates with the discharge valve 70 through a transfer pipe 44. The transfer pipe 44 preferably includes a collar 47 sized to frictionally engage and seal with the outlet 42.

To attach the bowl 36 to the frame 20, the bowl 36 is inserted through the opening 30 and positioned so that the tabs 39 are aligned with the slots 29 and the outlet 42 is aligned with the collar 47. The bowl 36 is lowered so that the tabs 39 pass through and lock with the slots 29. Simultaneously, the outlet 42 is inserted into and engages the collar 47. In this position, the out-turned flange 40 closely overlies the frame top member 28 so that downward forces applied to the bowl 36 are transferred to the frame 20. As a result, the bowl 36 is not a load-bearing component, and may be made of non-structural materials such as plastic, thin-walled metal (defined herein as less than approximately 0.040" thick), or other known alternatives. In addition, the bowl 36 is separable from the frame 20 and therefore may be replaced independently from the rest of the toilet 10. Still further, the tabs 39 may be manipulated manually, and therefore no tools are required to install or remove the bowl 36.

At least one rinse fluid dispenser, such as nozzles 46, is provided inside the bowl 36 for directing rinse fluid over the surface of the bowl. As best shown in FIGS. 1A and 1B, a plurality of nozzles 46 are spaced about the bowl sidewall 38 and are oriented to direct rinse fluid over portions of the bowl surface. The number of nozzles may be more or less than that shown, depending on the size of the bowl surface to be rinsed. As used herein, the phrase "rinse fluid dispenser" includes the illustrated nozzles 46, as well as known substitutes, such as spray rings.

A vacuum breaker 33 is positioned above the top edge of the bowl 36, and a first rinse fluid pipe 35*a* extends from the nozzles 46 to the vacuum breaker 33. A second rinse pipe 35*b* extends from the vacuum breaker 33 to the rinse valve 72. Quick-disconnect couplings 108*a*, 108*b* are provided to connect the first and second rinse fluid pipes 35*a*, 35*b* to the vacuum breaker.

The separate frame 20 advantageously allows the bowl 36 to be a line replaceable unit (LRU). When the bowl 36 becomes worn or otherwise needs replacement, a maintenance person may simply disconnect the first rinse fluid pipe 35*a* using the quick disconnect coupling 108*a*, manipulate the tabs 39 so that the are disengaged from the slots 29, and pull upward on the bowl 36 to remove the bowl 36 from the frame 20. A new bowl 36 may then be inserted into the frame 20 as described above, and the first rinse fluid pipe 35*a* may be connected to the vacuum breaker 33 using the quick-disconnect coupling 108*a*. As a result, the entire toilet need not be removed and serviced. The bowl replacement process is not only fast, but does not require the use of any tools. In addition to facilitating bowl removal and replacement, the frame 20 allows a wider range of materials to be used for the bowl 36, since the frame 20, rather than the bowl 36, supports the load.

The foregoing detailed description has be given for clearness of understanding only, and no unnecessary limitations should be understood therefrom, as modifications would be obvious to those skilled in the art.

What is claimed is:

1. A waste receptacle assembly for use in a vacuum toilet system having an inlet coupling, the waste receptacle assembly comprising:

a frame including at least two vertical supports and a top member attached to the at least two vertical supports, the top member defining an opening and having a receptacle engaging portion; and a receptacle sized for at least partial insertion through the frame top member opening, the receptacle having an abutting portion positioned to engage the receptacle engaging portion of the frame when the receptacle is at least partially inserted through the frame top member opening thereby to maintain the receptacle in an installed position, the receptacle further having an outlet sized and adapted for releasable sealing engagement with the inlet coupling when the receptacle is in the installed position;

wherein the receptacle is toollessly inserted into and removed from the installed position independent of the frame.

2. The assembly of claim 1, in which the frame includes at least one slot, and in which the receptacle includes a tab adapted to lockingly engage the slot, thereby to secure the receptacle in the installed position.

3. The assembly of claim 2, in which the tab is toollessly releasable to disengage from the slot.

4. The assembly of claim 1, in which the top member of the frame further defines the receptacle engaging portion.

5. The assembly of claim 4, in which the receptacle includes a flange defining the abutting portion of the receptacle.

6. The assembly of claim 1, in which the vacuum waste system further comprises a rinse valve and a rinse fluid pipe, and in which the receptacle further comprises a rinse fluid dispenser adapted for toollessly releasable attachment to the rinse fluid pipe.

7. The assembly of claim 1, in which the receptacle is made of a plastic material.

8. The assembly of claim 1, in which the receptacle is made of a thin-walled steel.

9. The assembly of claim 1, in which the receptacle is formed as a toilet bowl.

10. A method of toollessly replacing a receptacle of a waste receptacle assembly used in a vacuum toilet system having an inlet coupling, the waste receptacle assembly including a frame including at least two vertical supports and a top member attached to the at least two vertical supports defining an opening, the frame further having a receptacle engaging portion, the receptacle being sized for at least partial insertion through the frame top member opening and having an abutting portion positioned to engage the receptacle engaging portion of the frame to maintain the receptacle in an installed position, the receptacle further having an outlet sized and adapted for releasable sealing engagement with the inlet coupling, the method comprising:

lifting the receptacle while leaving the frame in place so that the abutting portion of the receptacle disengages from the receptacle receiving portion of the frame and the receptacle outlet disengages from the inlet coupling;

withdrawing the receptacle through the frame top member opening to remove the receptacle from the frame;

providing a new receptacle sized for at least partial insertion through the frame top member opening having an abutting portion positioned to engage the receptacle engaging portion of the frame and an outlet sized to sealingly engage the inlet coupling; and inserting a new receptacle at least partially through the frame top member opening so that the abutting portion of the new receptacle contacts the receptacle engaging portion of the frame and the outlet of the new receptacle engages the inlet coupling.

11. The method of claim 10, in which the frame includes at least one slot, and in which each of the receptacle and new receptacle includes a tab adapted to lockingly engage the slot, wherein the tab of the receptacle is removed from the slot during the lifting step and the tab of the new receptacle is inserted into the slot during the inserting step.

12. The method of claim 10, in which the top member of the frame further defines the receptacle engaging portion.

13. The method of claim 12, in which the each of the receptacle and new receptacle includes a flange defining the abutting portion.

14. The method of claim 10, in which the vacuum waste system further comprises a rinse valve and a rinse fluid pipe, and in which each of the receptacle and new receptacle further comprises a rinse fluid dispenser, the method further comprising detaching the rinse fluid dispenser of the receptacle from the rinse fluid pipe prior to the lifting step and attaching the rinse fluid dispenser of the new receptacle to the rinse fluid pipe after the inserting step.

15. The method of claim 10, in which the receptacle is made of a plastic material.

16. The method of claim 10, in which the receptacle is made of a thin-walled steel.

17. The method of claim 10, in which the receptacle is formed as a toilet bowl.

* * * * *